United States Patent [19]

Grisham et al.

[11] 4,438,961

[45] Mar. 27, 1984

[54] DOOR LATCH MEANS

[75] Inventors: C. Lynwood Grisham, Memphis; Freddie A. Grisham, Bartlett, both of Tenn.

[73] Assignee: Grisham Corporation, Arlington, Tenn.

[21] Appl. No.: 371,413

[22] Filed: Apr. 23, 1982

[51] Int. Cl.[3] ..... E05C 5/00

[52] U.S. Cl. ..... 292/67; 292/173

[58] Field of Search ..... 292/63-69, 292/207, 106, 228, DIG. 38, 173

[56] References Cited

U.S. PATENT DOCUMENTS

| | | | |
|---|---|---|---|
| 885,496 | 4/1908 | Leopold | 292/67 |
| 1,946,833 | 2/1934 | Brown | 292/228 |
| 2,078,073 | 4/1937 | Geske et al. | 292/63 |
| 2,807,839 | 10/1957 | Whaley | 292/67 X |
| 4,106,239 | 8/1978 | Bancroft et al. | 49/449 |

FOREIGN PATENT DOCUMENTS

| | | | |
|---|---|---|---|
| 327603 | 10/1920 | Fed. Rep. of Germany | 292/67 |
| 781016 | 2/1935 | France | 292/67 |
| 782341 | 3/1935 | France | 292/65 |

*Primary Examiner*—Gary L. Smith
*Assistant Examiner*—R. Illich
*Attorney, Agent, or Firm*—Walker & McKenzie

[57] ABSTRACT

A door latch for latching a swingably mounted door. The latch includes a striker assembly which is operable in a dual capacity. First, the striker assembly is pivotally operable for accomplishing the unlatching action or is arcuately swung in the act of being withdrawn from the keeper socket, thus unlatching the door latch. Second, at least a portion of the striker assembly is rectilinearly operable for accomplishing the latching action as it slidably engages the lip of the keeper socket and is subsequently thrust into the keeper socket as the door continues to be fully closed thus latching the door latch. A shaft extends through the mainbody of the striker for facilitating the unlatchable swinging action thereof and which carries handle or knob structure at either end thereof to further facilitate unlatching and opening the door.

2 Claims, 6 Drawing Figures

DOOR LATCH MEANS

BACKGROUND OF THE INVENTION

1. Field of the Invention

This invention relates to the field of latching mechanisms for latching a swingably mounted door of the type predominantly found in present day private dwellings.

2. Description of the Prior Art

The usual arrangement for latching mechanisms for purposes herein disclosed is to provide a striker which is thrust into the usual keeper socket and withdrawn therefrom through a rectilinearly movement. In other words, rotation of the usual doorknob structure causes the rectilinear movement of the striker as it is withdrawn from the keeper socket while swinging the door to the closed position again causes the rectilinear movement of the striker as it passes over the lip of the keeper socket. Thus, the keeper, in this arrangement, travels in a rectilinear direction both in the latching process of the door as it swings close and in the unlatching process of the door, i.e., by the rotation of the doorknob structure.

While the above mentioned type door latches are fully acceptable for most swingable mounted doors, they are not fully acceptable for certain doors particularly where space is a limitation, i.e., a well-known problem common to metal storm doors. More specifically, certain doors are inherently characterized by narrow stiles and do not readily accommodate the typical latch structure existing today, i.e., since the physical size of the typical latch exceeds the size of the narrow stile associated with these type doors.

Moreover, these prior type door latches usually included a rather complex array of structure, which by necessity, make them rather costly. Accordingly, the industry, as a whole, has experienced difficulty in holding the price of these type doors down to a desired reasonable level. Therefore, there exists a need for a simple latching mechanism that is inexpensive to manufacture and install and is compatible with the narrow stile doors or in situations where space is a limitation. However, it should be understood that the invention is likewise applicable to other type doors, i.e., where space is not a limitation. It is therefore contemplated that the invention shall not be limited solely to use on narrow stile doors.

Since the main thrust of the present invention is directed toward merely a latching mechanism, it is anticipated that it preferably (but not necessarily) would be used in conjunction with other structure for locking the door. Such locking mechanism is fully disclosed in a U.S. Pat. No. 2,989,859 issued to Eads on June 27, 1961 entitled "Narrow Stile Double Door Lock" and may hereinafter be simply referred to as '859 patent.

Since the '859 patent deals exclusively with a "locking mechanism for a narrow stile door" and the present invention is directed toward a "latching mechanism for a narrow stile door", it would be most desirable that a door be equipped with both of these devices which are fully compatible one with the other.

Applicant is aware of a U.S. Pat. No. 1,186,449 issued to Smith on June 6, 1916 for a latch mechanism especially adapted for vehicle doors that is characterized by incorporating striker structure which moves rectilinearly as well as arcuately in the operation thereof.

In addition, applicant is aware of a U.S. Pat. No. 2,128,014 issued to Platin on Aug. 23, 1938 for a door lock having a bolt that operates in such a manner that the door can always be opened and closed from the inside of the room to which it leads, while the door can be opened from the outside only upon having last been closed from this side. On the other hand, in the event the door was closed the last time from the inside, i.e., a person being left within the room, the door shall not permit being opened from the outside. In accomplishing this independent inside and outside operation, the bolt is actuated arcuately by the doorknob structure on one side of the door and is independently operated rectilinearly by the doorknob structure on the other side of the door. Obviously, this type door lock has a limited application.

It should be understood that none of the above mentioned patents suggests nor discloses applicant's device.

SUMMARY OF THE INVENTION

The present invention is directed toward overcoming the disadvantages and problems relative to previous door latch mechanisms.

Thus, one object of the invention is to devise the latching mechanism in such a fashion that it depicts a simple configuration which is strong and durable yet will be inexpensive to manufacture and install.

A further object of the invention is to provide a latching mechanism that is especially compatible with narrow stile type swing mounted doors, particularly the well-known current metal storm door wherein the usual stile is constructed from tubular steel having a fixed dimension, thus inherently creating a space limitation for subsequently receiving or accommodating most present day latch or lock structure.

Therefore, while the door latch of the present invention may be limited to latching a swingably mounted door, it epitomizes simple and comparatively inexpensive structure including a striker assembly which is operable in a dual capacity. More specifically, the striker is swingably or arcuately operable by being arcuately withdrawn from a keeper socket so as to unlatch the door latch mechanism. In addition, at least a portion of the striker is rectilinearly operable by being rectilinearly thrust into the keeper socket as the door swings shut to latch the door latch mechanism. The striker is further characterized by having a camming surface provided thereon which effectively rectilinearly depresses the striker as it slidably moves over the lip of the keeper socket and subsequently is rectilinearly thrust into the keeper socket in causing the latching action. A shaft extends through the main body of the striker for swingable operation thereof and carries handle or knob structure at either end thereof to facilitate unlatching and opening the door.

It will be appreciated that the above summary is couched in rather general language. Therefore, for a better understanding of this invention, one embodiment thereof will be fully described by making explicit reference to the accompanying drawings in which the various parts will progressively be disclosed or indicated by numerals arranged in an ascending order.

DESCRIPTION OF THE PREFERRED EMBODIMENT

Figure 1:
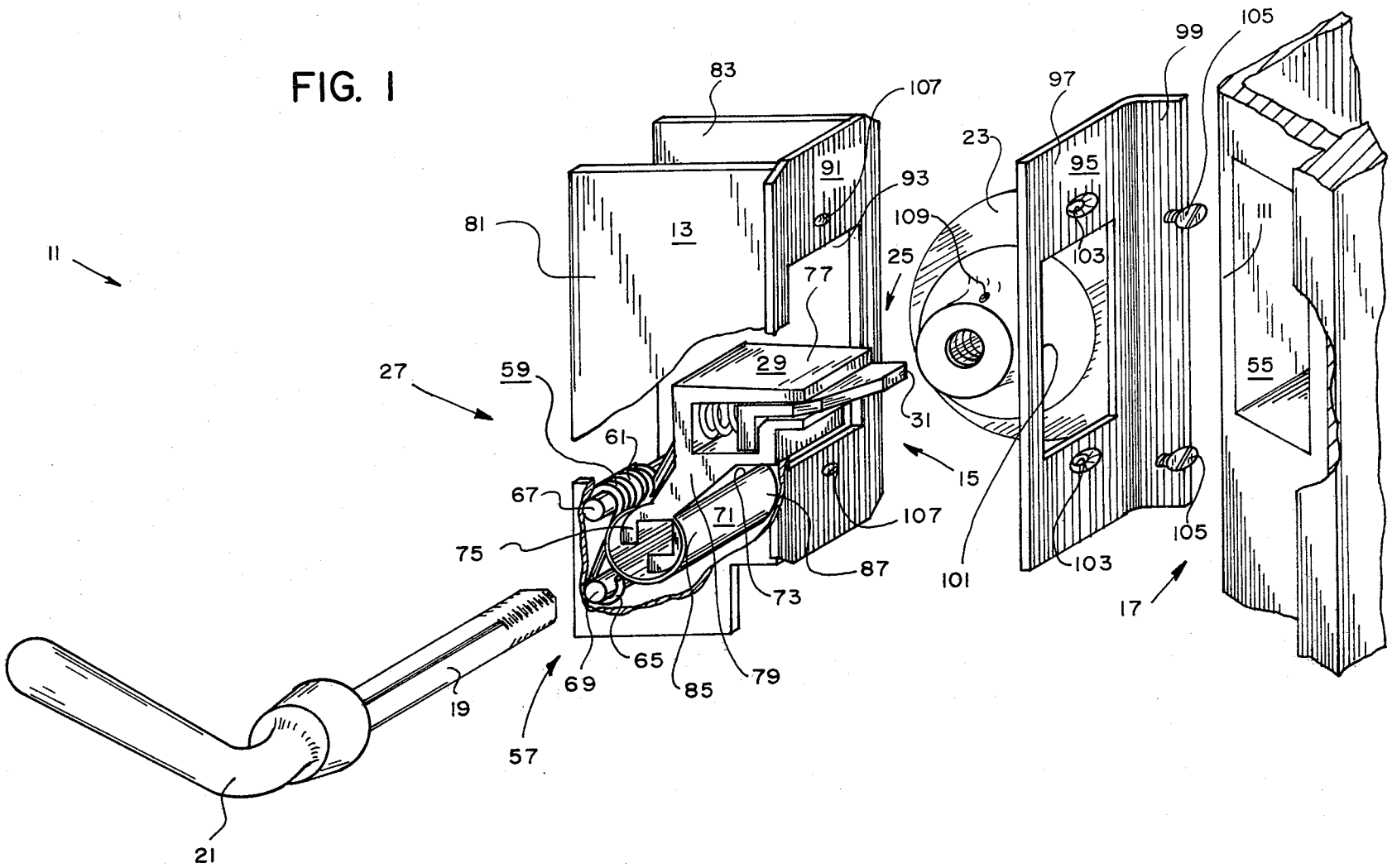
FIG. 1 is a perspective view showing the door latch means of the present invention in a partially exploded view and also showing a substantially typical keeper arrangement.

The door latch means 11 of the present invention is intended for latching a typical swingably mounted door. Therefore, since the door is well-known it will not be shown herein. From FIG. 1 of the drawings it may clearly be seen that the door latch means 11 of the present invention includes a boxlike housing, as at 13, for providing proper support for certain structure which may be disposed therein, e.g., the structure as shown in FIG. 2 and yet to be disclosed. The door latch means 11 also includes striker means, generally indicated at 15, disposed within the boxlike housing 13 for latchable engagement with suitably established jam-mounted keeper means, as at 17, which enables the door latch means 11 to properly latch the door while in the closed position thereof. A somewhat typical rock shaft, as at 19, extends through the housing 13 and is coupled with the striker means 15 for providing arcuate movement of the striker means 15, thus facilitating unlatching the closed door, i.e., the rock shaft 19 carries knoblike means, as at 21, 23 at either end thereof.

The door latch means 11 is further characterized by including first striker actuator means, generally indicated at 25 in FIG. 2 of the drawings, for latching the latch means 11, i.e., by establishing a rectilinear movement of at least a portion of the striker means which is caused to operatively engage the keeper means 17 as the door swings toward the closed position thereof. In this manner, the first striker actuator means 25 latches the door latch means 11 as the door swings close.

The door latch means 11 is further characterized by including second striker actuator means, generally indicated at 27 in FIG. 2 of the drawings, for unlatching the latch means 11, i.e., by establishing arcuate movement of the striker means 15 through rotation of the rock shaft 19. In this manner, the second striker actuator means 27 enables the door latch means 11 to be unlatched by a mere turning action of either of the knoblike means 21, 23.

Figure 2:
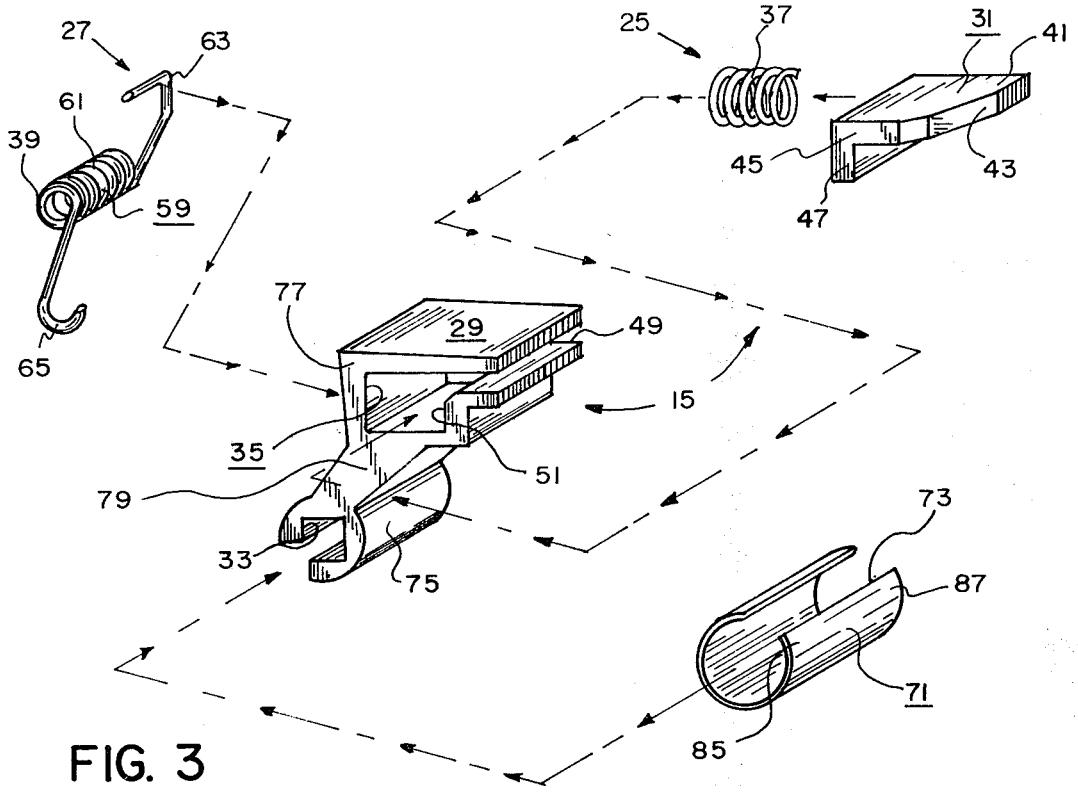
FIG. 2 is an exploded view of merely the internal structure of the door latch means.
Figure 3:
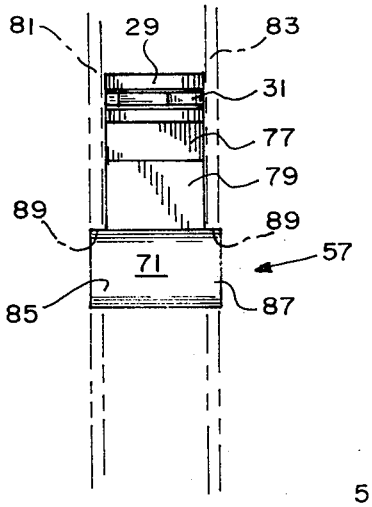
FIG. 3 is an end view depicting the internal structure in an assemblied condition.
Figure 4:
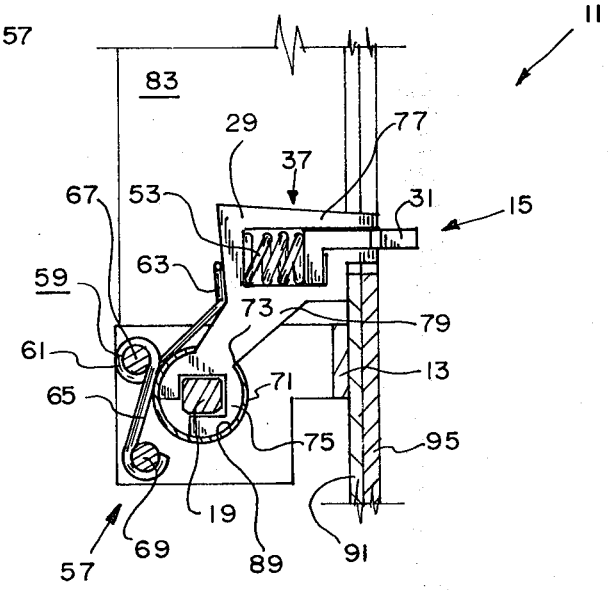
FIG. 4 is a side elevational view depicting the structure as shown in FIG. 2 as it would appear when properly assembled and with the latch being shown in its latched position.
Figure 5:
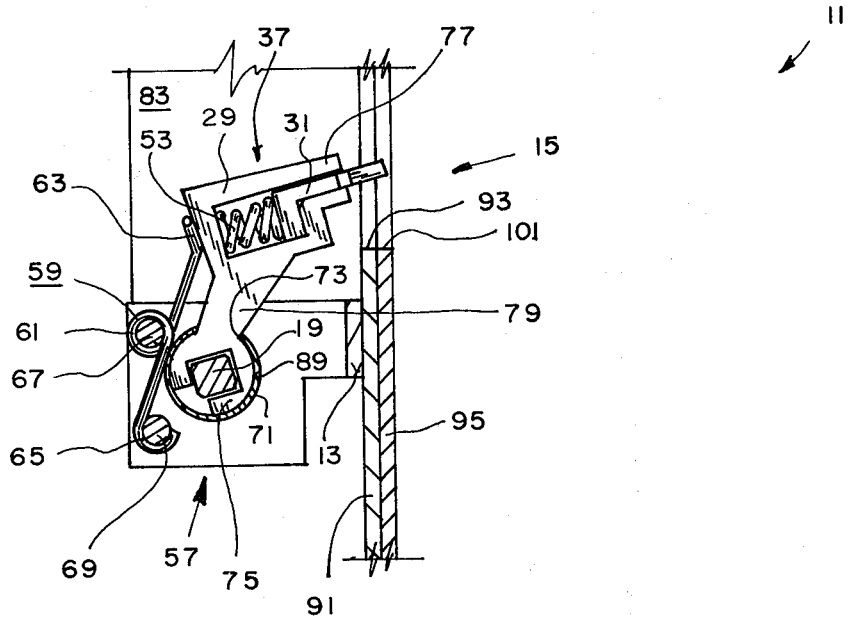
FIG. 5 is a view similar to FIG. 4 depicting the latch structure in an unlatched position.
Figure 6:
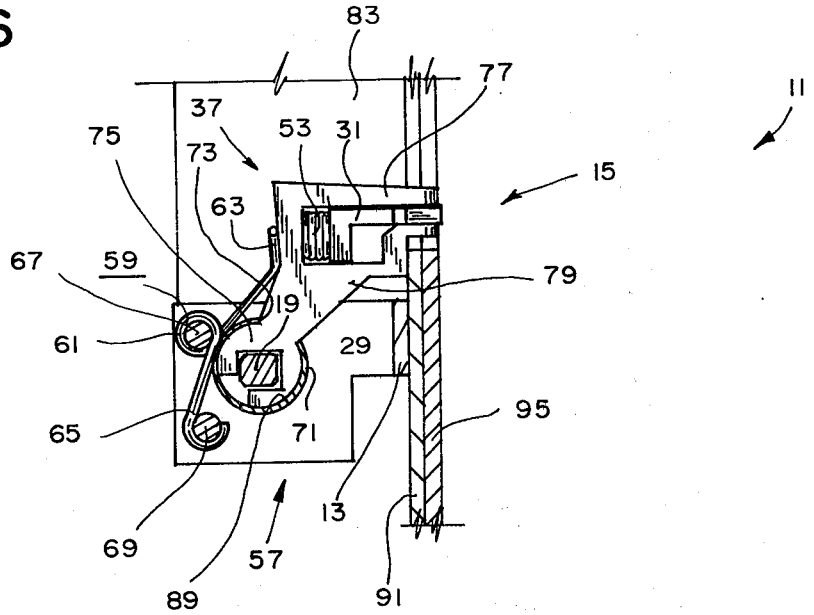
FIG. 6 is a view also similar to FIG. 4 except certain structure is shown in a displaced position to depict movement thereof which takes place exclusively during the latching action.

From FIGS. 1 and 2 of the drawings it may also readily be seen that the striker means 5 alluded to above includes mainbody means, as at 29, which is responsive to the second striker actuator means 27, i.e., in a manner yet to be described. FIGS. 4–6 show the preferred manner in which the mainbody means 29 is coupled with the rock shaft 19 for arcuate movement therewith. Furthermore, it may be seen that the striker means 15 also includes tonguelike means, as at 31, which is responsive to the first striker actuator 25, i.e., in a manner yet to be described, for latchable engagement with the keeper means 17. The mainbody means 29 is provided with a particular passageway, as at 33 in FIG. 2 of the drawings, which is especially constructed for matably receiving the rock shaft 19 in such a manner that when the rock shaft 19 is manually turned about its longitudinal axis the mainbody means 29 is caused to be swingably carried therewith. In other words, the preferred shape of the passageway 33 is rectangular as shown in FIG. 2 and the rock shaft 19 is rectangularly shaped likewise for compatible engagement one with the other.

The mainbody means 29 is further provided with a peculiar slot, as at 35 in FIG. 2 of the drawings, for slidably receiving the tonguelike means 31, i.e., in the manner best shown in FIGS. 1 and 4 through 6 of the drawings. The first striker actuator means 25 alluded to above preferably includes first bias means, as at 37 in FIG. 2 of the drawings, which is disposed within the slot 35 for operable engagement with the tonguelike means 31 and for yieldably urging the tonguelike means 31 toward the keeper means 17.

From FIG. 2 of the drawings it may also be seen that the second striker actuator means 27 includes second bias means, as at 39, which is disposed within the boxlike housing 13 for operable engagement with the mainbody means 29 and for yieldably urging the striker means 15 swingably toward the keeper means 17.

In addition, it may be seen that the tonguelike means 31 includes a thrustable protruding member, as at 41, which has a camlike portion, as at 43, for acting with the keeper means 17 in latching the door latch means 11. Furthermore, the tonguelike means 31 includes an internal member, as at 45, which has a buttlike portion, as at 47, for restingly engaging the first bias means 37.

Moreover, the slot 35 is provided with an outwardly directed narrow portion, as at 49, for slidably receiving the thrustable protruding member 41. Furthermore, the outwardly directed portion 49 leads into an inwardly disposed broad portion, as at 51, for slidably receiving the above mentioned buttlike portion 47 and the first bias means 37.

From FIGS. 4 through 6 of the drawings it may be seen that the first bias means 37 includes compression spring means 53, shown properly disposed within the inwardly disposed broad portion 51 of the slot 35. Moreover, one end of the compression spring means 53 bears against a portion of the mainbody means 29, i.e., the portion defining in part the inwardly disposed broad portion 51 of the slot 35, and the other end of the compression spring means 53 bears against the buttlike member 47. In this manner, the compression spring means 53 yieldably urges the thrustable protruding member 41 into a socket, as at 55 in FIG. 1, which is provided in the keeper means 17, i.e., the thrustable protruding member 41 is yieldably urged into the socket 55 as the door is swingably closed to effect the latching action of the door latch means 11.

From FIGS. 1 and 4 through 6 of the drawings it may be seen that the second striker actuator means 27 includes support means, generally indicated at 57, for pivotally supporting the mainbody means 29 within the boxlike housing 13. In addition, it may be seen that the second bias means 39 includes torsion spring means, as at 59, which has a coiled member 61 and a pair of torsion-applying leg members 63, 65 which are constituted by integrally joined extensions of the coiled member 61.

The second striker actuator means 27 additionally includes coil pin means, as at 67, which is fixedly attached (in any well known manner such as welding or the like) to the boxlike housing 13 for circumflexably receiving and thus supporting the coiled member 61, i.e., in a manner as best shown in FIG. 1 of the drawings. The second striker actuator means 27 also includes leg pin support means, as at 69, which is fixedly attached (in any well known manner such as welding or the like) to the boxlike housing 13 for engagement with and thus supporting one of the leg members, e.g., the leg member 65. Additionally, the leg member other than the leg member 65, e.g., the leg member 63, is bearing against the mainbody means 29 so as to yieldably urge the striker means 15 toward the keeper means 17, or more specifically, into the socket 55 provided therein.

The support means 57 alluded to above includes an elongated sleevelike member, as at 71, which is provided with an elongated interruption or slit, as at 73, which coextends the length of the member 71, as best shown in FIG. 2 of the drawings. From FIG. 2 of the drawings it may also clearly be seen that the mainbody means 29 includes a cylindricallike member, as at 75, which is substantially concentrically disposed about the previously mentioned passageway 33. Furthermore, the diameter of the cylindricallike member 75 is compatibly sized with respect to the internal diameter of the sleevelike member 71 for contiguous reception therein, i.e., in the manner as best shown in FIG. 1 of the drawings.

From FIG. 2 of the drawings it may readily be seen that the cylindricallike member 75 establishes merely a proximal portion of the mainbody means 29. Accordingly, the mainbody means 29 also includes a distal portion, as at 77, which is provided with the previously mentioned and fully described slot 35, i.e., the slot 35 has the tonguelike means 31 slidably received therein, (as best shown in FIG. 1 of the drawings). Moreover, the proximal and distal portions 75, 77 respectively are joined one with the other by an extension arm, as at 79, which passes through the previously mentioned interruption 73, i.e., provided in the elongated sleevelike member 71 or as best viewed in FIG. 1 of the drawings. In addition, the extension arm 79 has sufficient length for providing optimum arcuate travel of the distal portion 77 for assuring withdraw of the tonguelike means 31 from the keeper means 17 (i.e., the socket 55) as the rock shaft 19 is manually turned (by either of the knoblike means 21, 23).

Moreover, the cylindricallike member or proximal portion 75 has sufficient length to enable it to freely fit between a pair of spaced apart confrontingly arranged walls, as at 81, 83 in FIG. 1 of the drawings, which define at least in part the boxlike housing 13. Furthermore, the elongated sleevelike member 71 (being slightly longer than is the cylindricallike member 75) has sufficient length to enable the opposite ends thereof, as at 85, 87, to be pivotally received in a pair of aligned apertures, as at 89, respectively provided in the spaced apart confrontingly arranged walls 81, 83 of the boxlike housing 13, i.e., in this manner providing optimum pivotal support for the mainbody means 29 within the boxlike housing 13.

Since the door latch means 11 of the present invention may be used with certain door lock means, e.g., possibly like the previously mentioned Eads invention U.S. Pat. No. 2,989,859, the door latch means 11 does not necessarily include lock structure. However, it will be appreciated that the door latch means 11 may, if desired, be used independent of any other door lock structure. Therefore, it would be beneficial to incorporate some simple means of locking the door latch means 11. For example, an eccentrically mounted rotorary disc (not shown) could be mounted above the mainbody means 29 (or more specifically the distal portion 77 thereof) for operation on the inside of the door, i.e., for movement between a "locked position" in which the disc would engage the top of the distal portion 77 and an "unlocked position" in which the disc would be displaced a distance from the distal portion 77 sufficient to permit the swinging movement thereof.

From FIGS. 1, and 4 through 6 of the drawings it may be seen that the door latch means 11 includes a typical face plate, as at 91 which is provided with a rather large opening, as at 93, through which the striker means 15 may freely pass during the latching and unlatching thereof.

In addition, a typical tamper proof plate member, as at 95, may be provided which includes a first portion, as at 97, which contiguously engages the face plate 91, and a second portion, as at 99, which is adapted to be disposed on the exterior of the door so as to deny tampering access to the striker means 15. The first portion 97 is provided with a rather large opening, as at 101, through which the striker means 15 may freely pass, i.e., the opening 101 preferably is identical with the opening 93 and properly aligned therewith. Furthermore, the socket 55 should be aligned with the openings 93, 101.

The first portion 97 is also provided with a pair of tapered apertures, as at 103, through which a pair of flat headed screws, as at 105, may freely pass. Moreover, the face plate 91 is provided with a pair of threaded apertures, as at 107, for threadedly receiving the screws 105. In the arrangement shown in FIG. 1 of the drawings, the knoblike means 21 preferably is provided with the typical screw arrangement, as at 109, for enabling the knoblike means 21, 23 to be suitably attached in place.

The operation of the door latch means 11 is quite simple in that it is latched when in the position shown in FIG. 4 of the drawings and is unlatched when in the position shown in FIG. 5, i.e., the entire mainbody means 29 is caused to swingably withdraw from the keeper socket 55 when the rock shaft 19 is manually turned by either of the knoblike means 21, 23, thus swinging to the position in FIG. 5 of the drawings.

The door latch means 11 assumes the "latched position" shown in FIG. 4 of the drawings by the mere swinging action of the door to the closed position thereof. In other words, the camlike portion 43 of the thrustable protruding member 41 (see FIG. 2) causes the compression spring means 53 to be loaded or moved to the position shown in FIG. 6 of the drawings as the camlike portion 43 slidably engages the keeper means 17 or more specifically a lip, as at 111 in FIG. 1, which defines the keeper socket 55. Ultimately, the thrustable protruding member 41 will come into alignment with the keeper socket 55 which, of course, enables the compression spring means 53 to unload or thrust the thrustable protruding member 41 into the keeper socket 55, thus assuming the position shown in FIG. 4 of the drawings.

Of course, it should be mentioned that the torsion spring means 59 urges the distal portion 77 of the mainbody means 29 toward the keeper socket 55, i.e., the torsion spring means 59 causes the mainbody means 29 to assume the position shown in FIG. 4 of the drawings automatically by releasing the knob means 21, 23. In other words, the torsion spring means 59 is loaded by the turning action of the knob means 21 or 23 and the distal portion 77 is driven into the keeper socket 55 by releasing the knob means 21, 23 which allows the spring means 59 to unload.

Although the invention has been described and illustrated with respect to a preferred embodiment thereof, it should be understood that it is not intended to be so limited since changes and modifications may be made therein which are within the full intended scope of the invention.

I claim:

1. Door latch means for latching a swingably mounted door, said door latch means comprising a boxlike housing, striker means disposed within said boxlike housing for latchable engagement with suitably established jammounted keeper means and for enabling said door latch means to properly latch the door while in the closed position thereof, a rock shaft extending through said housing and being coupled with said striker means and carrying knoblike means at either end thereof for providing arcuate movement of said striker means thus facilitating unlatching the closed door, first striker actuator means for causing latching action of said latch means by establishing a rectilinear movement of at least a portion of said striker means which is caused to operatively engage the keeper means thus latching the door as it swings toward the closed position thereof, and second striker actuator means for unlatching said latch means by establishing arcuate movement of said striker means through rotation of said rock shaft, thus said second striker means enables said door latch means to be unlatched by a mere turning action of either of said knoblike means; said striker means including mainbody means responsive to said second striker actuator means and being coupled with said rock shaft for arcuate movement therewith, and tonguelike means responsive to said first striker actuator means for latchlike engagement with the keeper means, said mainbody means being provided with a passageway especially constructed for matably receiving said rock shaft in such a manner that when said rock shaft is manually turned about its longitudinal axis said mainbody means is caused to be swingably carried therewith, said mainbody means being further provided with a slot for slidably receiving said tonguelike means; said first striker actuator means including first bias means disposed within said slot for operable engagement with said tonguelike means and for yieldably urging said tonguelike means toward the keeper means; said second striker actuator means including second bias means disposed within said boxlike housing for operable engagement with said mainbody means and for yieldably urging said striker means swingably toward the keeper means; said second striker actuator means including support means for pivotally supporting said mainbody means within said boxlike housing; said second bias means including torsion spring means having a coiled member and a pair of torsion applying leg members constituted by integrally joined extensions of said coiled member; said second striker actuator means additionally including coil pin means fixedly attached to said boxlike housing for circumflexably receiving and thus supporting said coiled member, and leg pin support means fixedly attached to said boxlike housing for engagement with and thus supporting one of said leg members while the leg member other than said one of said leg members is bearing against said mainbody means so as to yieldably urge said striker means swingably toward the keeper means; said support means including an elongated sleevelike member provided with an elongated interruption coextending the length thereof; said mainbody means including a cylindricallike member which is substantially concentrically disposed about said passageway with the diameter of said cylindricallike member being compatibly sized with respect to the internal diameter of said sleevelike member for contiguous reception therein.

2. The door latch means as set forth in claim 1 in which said cylindricallike member of said mainbody means establishes a proximal portion thereof, and in which said mainbody means includes a distal portion which is provided with said slot which has said tonguelike means slidably received therein, said proximal and said distal portions being joined one with the other by an extension arm which passes through said interruption provided in said elongated sleevelike member and having sufficient length for providing optimum travel of said distal portion for assuring withdrawal of said tonguelike means from the keeper means as said rock shaft is manually turned, and in which said cylindricallike member has sufficient length to enable it to freely fit between a pair of spaced apart confrontingly arranged walls defining in part said boxlike housing, while said elongated sleevelike member has sufficient length to enable the opposite ends thereof to be pivotally received in a pair of aligned apertures respectively provided in the spaced apart confrontingly arranged walls of said boxlike housing, thus providing optimum pivotal support of said mainbody means within said boxlike housing.

* * * * *